US008460123B1

(12) United States Patent
Demille et al.

(10) Patent No.: US 8,460,123 B1
(45) Date of Patent: Jun. 11, 2013

(54) GOLF CLUB HEAD WITH A COMPRESSION-MOLDED, THIN-WALLED AFT-BODY

(75) Inventors: Brandon D. Demille, Carlsbad, CA (US); J. Andrew Galloway, Escondido, CA (US); Martin Peralta, Oceanside, CA (US); D. Clayton Evans, San Marcos, CA (US); William C. Watson, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 385 days.

(21) Appl. No.: 12/939,477

(22) Filed: Nov. 4, 2010

Related U.S. Application Data

(63) Continuation-in-part of application No. 12/886,773, filed on Sep. 21, 2010, which is a continuation-in-part of application No. 12/876,397, filed on Sep. 7, 2010.

(60) Provisional application No. 61/245,583, filed on Sep. 24, 2009, provisional application No. 61/242,469, filed on Sep. 15, 2009.

(51) Int. Cl.
*A63B 53/04* (2006.01)

(52) U.S. Cl.
USPC ..... 473/345; 473/347; 473/349

(58) Field of Classification Search
USPC ..... 473/324–350
See application file for complete search history.

(56) References Cited

U.S. PATENT DOCUMENTS

| | | | | |
|---|---|---|---|---|
| 3,840,239 | A * | 10/1974 | Fazekas et al. | 277/644 |
| 4,581,190 | A * | 4/1986 | Nagamoto et al. | 264/136 |
| 5,720,668 | A * | 2/1998 | Brett | 473/252 |
| 5,800,285 | A * | 9/1998 | Thorne et al. | 473/324 |
| 6,379,258 | B1 * | 4/2002 | To | 473/242 |
| 6,471,604 | B2 * | 10/2002 | Hocknell et al. | 473/334 |
| 6,482,107 | B1 * | 11/2002 | Urbanski et al. | 473/331 |
| 6,623,378 | B2 * | 9/2003 | Beach et al. | 473/345 |
| 6,729,967 | B2 * | 5/2004 | Ford | 473/242 |
| 7,261,645 | B2 * | 8/2007 | Oyama | 473/345 |
| 7,396,296 | B2 * | 7/2008 | Evans | 473/344 |
| 7,607,992 | B2 * | 10/2009 | Nishio | 473/342 |
| 2005/0215352 | A1 * | 9/2005 | Oyama | 473/345 |
| 2008/0300068 | A1 * | 12/2008 | Chao | 473/342 |

* cited by examiner

*Primary Examiner* — Alvin Hunter
(74) *Attorney, Agent, or Firm* — Rebecca Hanovice; Michael A. Catania; Sonia Lari

(57) ABSTRACT

A multiple-material golf club and a method for forming said golf club is disclosed herein. The multiple-material golf club preferably is a driver that has a metal face cup and a thin-walled, compression molded, composite aft body with precise IML and OML geometry. The molding composite used to form the compression molded aft body preferably comprises a plurality of randomly oriented carbon fiber bundles and a thermoset matrix material.

18 Claims, 4 Drawing Sheets

GOLF CLUB HEAD WITH A COMPRESSION-MOLDED, THIN-WALLED AFT-BODY

CROSS REFERENCES TO RELATED APPLICATIONS

The present application claims priority as a continuation-in-part application to U.S. Utility patent application Ser. No. 12/886,773, filed on Sep. 21, 2010, which claims priority to U.S. Provisional Patent Application No. 61/245,583, filed on Sep. 24, 2009, the disclosures of each of which are hereby incorporated by reference in their entirety herein. The present application also claims priority as a continuation-in-part application to U.S. Utility patent application Ser. No. 12/876,397, filed on Sep. 7, 2010, which claims priority to U.S. Provisional Patent Application No. 61/242,469, filed on Sep. 15, 2009, the disclosures of each of which are hereby incorporated by reference in their entirety herein.

STATEMENT REGARDING FEDERALLY SPONSORED RESEARCH OR DEVELOPMENT

Not Applicable

BACKGROUND OF THE INVENTION

1. Field of the Invention

The present invention relates to a multiple material golf club head. More specifically, the present invention relates to a multiple material golf club head with a compression-molded, thin-walled aft body.

2. Description of the Related Art

There are various problems with the current process for manufacturing multiple material golf club heads. For example, in a standard compression molding process, the hard metal tooling on both sides of the molding part makes it impossible to create undercuts without significantly increasing tool complexity.

Another problem lies in the fact that standard molding compounds are not designed to be used in parts with very thin walls. When wall thicknesses are less than approximately 0.080 inches, it is difficult to compression mold most standard molding compounds. Furthermore, standard molding compounds are not as strong, stiff, or tough as laminated composites made with similar matrix and fiber types. Laminate composites are not ideal either because the raw materials used for current laminates are expensive. This cost is compounded by the very high scrap rate involved in molding them. Furthermore, the use of prepreg material requires hand placement of each layer of material into a mold, a time-consuming and labor-intensive process.

Another problem lies in the fact that latex bladders, which allow manufacturers to avoid undercut constraints, cause parts to lose definition on their inside surfaces. Metal tooling dictates the outer molding line (OML) of the parts quite well, but the part thickness and inner molding line (IML) of the molded parts are determined by the number of plies placed in each area and the amount of pressure exerted on the area by the bladder during the cure. As a result, it is difficult to predict the mass properties of a multiple-material body before a part is made.

One-piece bladder molded driver bodies also do not work well with a body-over-face joint. Bladder molded multiple material driver design had been restricted to body-under-face joints so that the body bond surface is a well controlled OML surface. The lack of precision on the inside of the head, however, makes it difficult to control the geometry of the body where it would meet up with the face.

Another problem lies with the fact that typical epoxy-based prepregs take at least twenty to thirty minutes, and often longer, to cure. In one multiple material golf club head fabrication process, the latex bladders used to apply pressure during the cure cycle can only be used two or three times before they need to be discarded. As such, bladders are a significant cost in the current multiple material golf club manufacturing process.

BRIEF SUMMARY OF THE INVENTION

One aspect of the present invention is a driver type golf club head comprising a metal face cup and a composite aft body comprising a crown and a sole, wherein the composite crown and sole are compression molded, wherein the composite in the crown and sole comprises fibers having random orientation, and wherein an outer molding line and an inner molding line of the crown and the sole are precision-molded.

The aft body may have a wall thickness of between 0.020 and 0.125 inches, and more preferably between 0.030 and 0.055 inches. The crown and sole may be molded separately. The composite used to form the crown and sole may comprise carbon fibers, and the carbon fibers may compose 10-70% of the volume of the composite in the crown and sole, and more preferably compose 40-50% of the volume of the composite in the crown and sole. The composite aft body may comprise at least twenty million carbon fibers. The composite used to form the crown and sole may further comprise a matrix material, preferably a thermosetting material, and most preferably a vinyl ester. At least one of the face cup, crown, and sole may comprise alignment markings, and more preferably both the crown and sole comprise alignment markings. The metal face cup may comprise a material selected from the group consisting of titanium, titanium alloy, aluminum, aluminum alloy, steel, magnesium, and magnesium alloy, and more preferably is composed of a titanium alloy.

Another aspect of the present invention is a method of forming a composite aft body for a driver type golf club head, comprising providing a plurality of bundles of carbon fibers, mixing the plurality of bundles with a matrix material so that the bundles are assorted randomly to form a composite molding compound, providing a male and female metal tooling mold, placing the composite molding compound in the female metal tooling mold, compressing the composite molding compound within the female metal tooling mold with the male metal tooling mold to create a composite piece, allowing the composite piece to cure, and bonding the composite piece to another piece of the driver type golf club head, wherein each bundle of carbon fibers is unidirectional, and wherein each bundle includes no more than 12,000 carbon fibers. In a further embodiment of the present invention, each bundle includes no more than 3,000 carbon fibers. The matrix material used in this aspect of the invention may be a thermosetting material, and more preferably a vinyl ester. Furthermore, the carbon fibers used in the present invention may each be between ¼ inch and 2 inches long.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention provides a solution to the problems set forth above by providing a preferred molding compound and a process for forming a composite aft body for a golf club. To create the molding compound of the present invention, bundles of aligned carbon fibers are randomly assorted and combined with a matrix material to provide a lightweight, strong, low density, composite molding material. The molding process of the present invention involves placing the molding compound of the present invention in a molding tool and compression molding one or more pieces of a golf club body such that the pieces have both uniform strength and precise geometry control in the form of OML and IML surfaces. The compression molding process of the present invention thus eliminates the need for any consumable bladder and makes the golf club manufacturing process more efficient and cost-effective.

Molding Compound

Fibers

Standard molding compounds generally have a lower strength, stiffness and impact toughness than continuous fiber laminates (e.g., prepreg sheets). As discussed herein, the inventors have determined several ways to improve the material properties of molding compounds.

One way of improving the material properties of standard molding compounds is to utilize longer carbon/graphite fibers and higher fiber content. The inventors have determined that the combination of strength and toughness available from "long fiber" material is adequate for a golf club head application. Fibers between ¼" and 2" long are utilized in the preferred molding compound. The strength and toughness available from laminated composite is also adequate for a golf club head, but the benefits are outweighed by the higher cost, slower cycle time involved in using laminated composite, and lack of precision in wall thickness and IML and OML. In contrast, the strength and toughness available from short fiber reinforced polymer or unreinforced polymer is not adequate for a golf club head.

In addition, or alternatively, adding micro- and nano-fillers (e.g., carbon nanotubes, nanoclays, etc.) may increase the material properties of standard molding compounds. Another approach to improve the material properties of standard molding compounds is to use a combination of continuous fiber-reinforcement (prepreg) and molding compounds. Molding compounds of interest can be reinforced by fibers, including carbon, fiberglass, aramid or any combination of the three.

Figure 1:
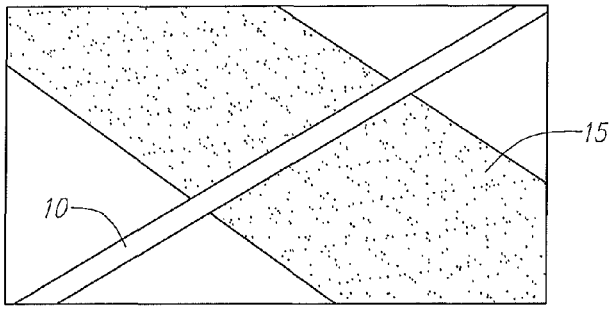
FIG. 1 is a electron microscope photograph of a carbon fiber and a human hair.
Figure 2:
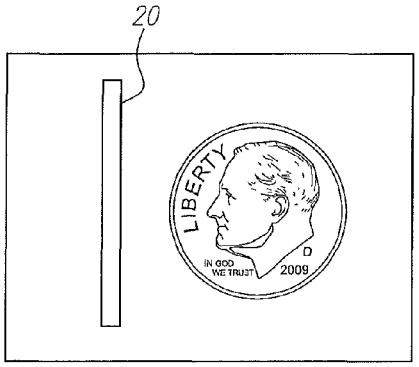
FIG. 2 is a photograph of a carbon fiber bundle next to a U.S. dime.
Figure 3:
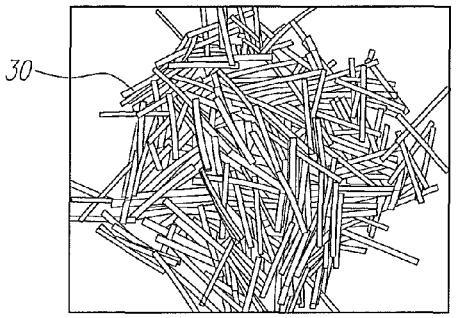
FIG. 3 is a photograph of a group of carbon fiber bundles.
Figure 4:
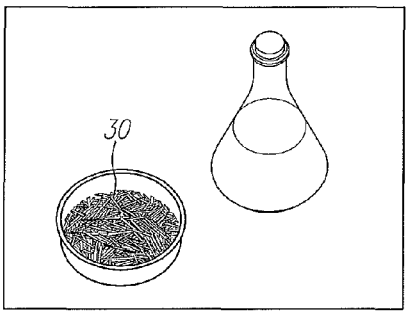
FIG. 4 is a photograph the carbon fiber bundles shown in FIG. 3 next to a beaker of matrix material.

FIG. 1 shows a single carbon fiber 10 compared with a human hair 15, and FIG. 2 shows a bundle 20 of 3,000 unidirectional carbon fibers compared with a U.S. dime. According to the present invention, a bundle can comprise up to 12,000 carbon fibers. In a preferred embodiment of the molding compound of the present invention, the fiber bundles 20 comprise 3,000-fiber tows instead of the 12,000-fiber (or more) tows. A plurality of these 3,000-fiber tow bundles are randomly assorted within a small area and combined with a matrix material to create a material that comprises over 500,000 randomly assorted fibers per square inch in a typical golf club component, or, more generally, ten million randomly assorted fibers per cubic inch. FIG. 3 shows an example of random assortment 30 of carbon fiber bundles according to the present invention, and FIG. 4 shows a random assortment 40 of carbon fiber bundles associated with a matrix material. Random assortment of the fiber bundles within the matrix material results in the directionality of each of the fiber bundles being randomly oriented, which improves the strength of the resulting material. When the molding compound of the present invention is used to create an aft body of, for example, a 420 to 470 cc golf club driver, the aft body may comprise over twenty million fibers in total, and preferably at least twenty three million fibers.

Molding Compound

Matrix Material

The matrix material that is combined with the fiber bundles to create the molding compound of the present invention can be a thermosetting (epoxy, polyester, vinyl ester, etc.) or a thermoplastic (nylon, polycarbonate, PPS, PEKK, PEEK, etc.) material, preferably a thermosetting material, and most preferably a vinyl ester. Alternatively, epoxy-based matrix compounds may be utilized since these compounds provide better strength and impact resistance than vinyl ester. Vinyl ester matrix molding compounds are strong and can cure in as little as one minute. Quick curing epoxy-based molding compounds have cure times as low as five minutes. The fiber in the resulting molding material may compose approximately 40 to 50%, and up to 70%, of the total molding material by volume.

Molding Compound

Characteristics

Figure 5:
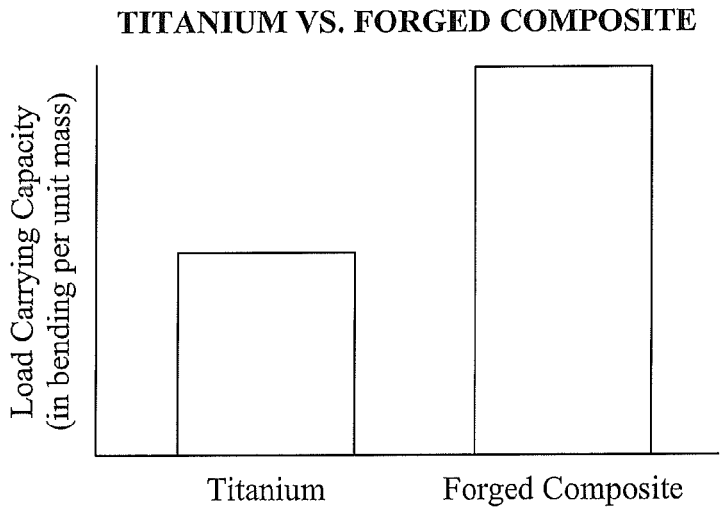
FIG. 5 is a graph showing load carrying capacities of titanium and composite materials.

Due to the fiber bundle diameter, size, and random assortment, the molding compound of the present invention is lighter than a piece of titanium having the same size and shape and has a density that is equivalent to approximately one third of the density of titanium. In the preferred embodiment, the density of the molding compound is between 1 and 2 grams per cubic centimeter, and most preferably is approximately 1.5 grams per cubic centimeter. As such, a golf club aft body formed from the composite compound of the present invention will be lighter and less dense than an aft body formed from titanium. The molding compound of the present invention also has a higher load carrying capacity than titanium in terms of bending per unit mass. FIG. 5 shows that the molding composite of the present invention has approximately twice the load carrying capacity of titanium per unit mass.

The molding composite ("MC") of the present invention can carry 2.4 times as much bending moment as a titanium beam. The equation for stresses in a beam subjected to a bending moment is as follows, $$\sigma(y) = \frac{My}{I},\ I = \frac{bh^3}{12}$$

where σ is the tensile or compressive stress along the length of the beam, M is the applied moment, y is the distance above the neutral axis, b is the beam width, and h is the beam thickness. The stress in the beam varies linearly through its thickness, with extremes occurring on the top and bottom surfaces.

$$\sigma_{max} = \sigma(y = \pm h/2) = \pm\frac{6M}{bh^2}$$

If the moment is positive, the maximum tensile stress occurs at the top surface of the beam, where y=h/2. To compare beams made from titanium to beams made of the molding compound of the present invention, it is useful to consider beams of equal mass. In the design of a driver body, the most convenient design flexibility often lies in the ability to change wall thickness. To represent this flexibility, two beams of equal width and length, but with different thicknesses, are compared. The thicknesses are scaled according to material density to create the dimensions of beams of equal mass.

The density of titanium is roughly three times that of the molded composite of the present invention, so the titanium beam needs to be one third as thick in order to have the same mass. Using the equations above, the stresses in the two beams are compared.

$$\sigma_{max,Ti} = \frac{6M}{b\left(\frac{h_{MC}}{3}\right)^2} = \frac{54M}{bh_{MC}^2} = 9\sigma_{max,MC}$$

Titanium and the molding composite ("MC") of the present invention have the following bending moment relationship, which demonstrates a strength advantage of the molding compound of the present invention.

$$\frac{\sigma_{max,Ti}}{\sigma_{y,Ti}} = 2.4\left(\frac{\sigma_{max,MC}}{\sigma_{u,MC}}\right)$$

The lower density of the molding compound of the present invention allows for thicker cross-sections at equivalent mass, and the resulting load carrying capacity is much greater. This allows designers to reinforce areas of a club head subjected to large bending loads without adding as much mass as would be required with a titanium head. The result is a more efficient head design and more discretionary mass, which can be used to help make drivers longer and straighter. The mass can be used to improve forgiveness through the use of selective weighting and center of gravity (CG)/moment of inertia (MOI) optimization, or it can be removed from the head for higher head speeds and longer drives.

Figure 6:
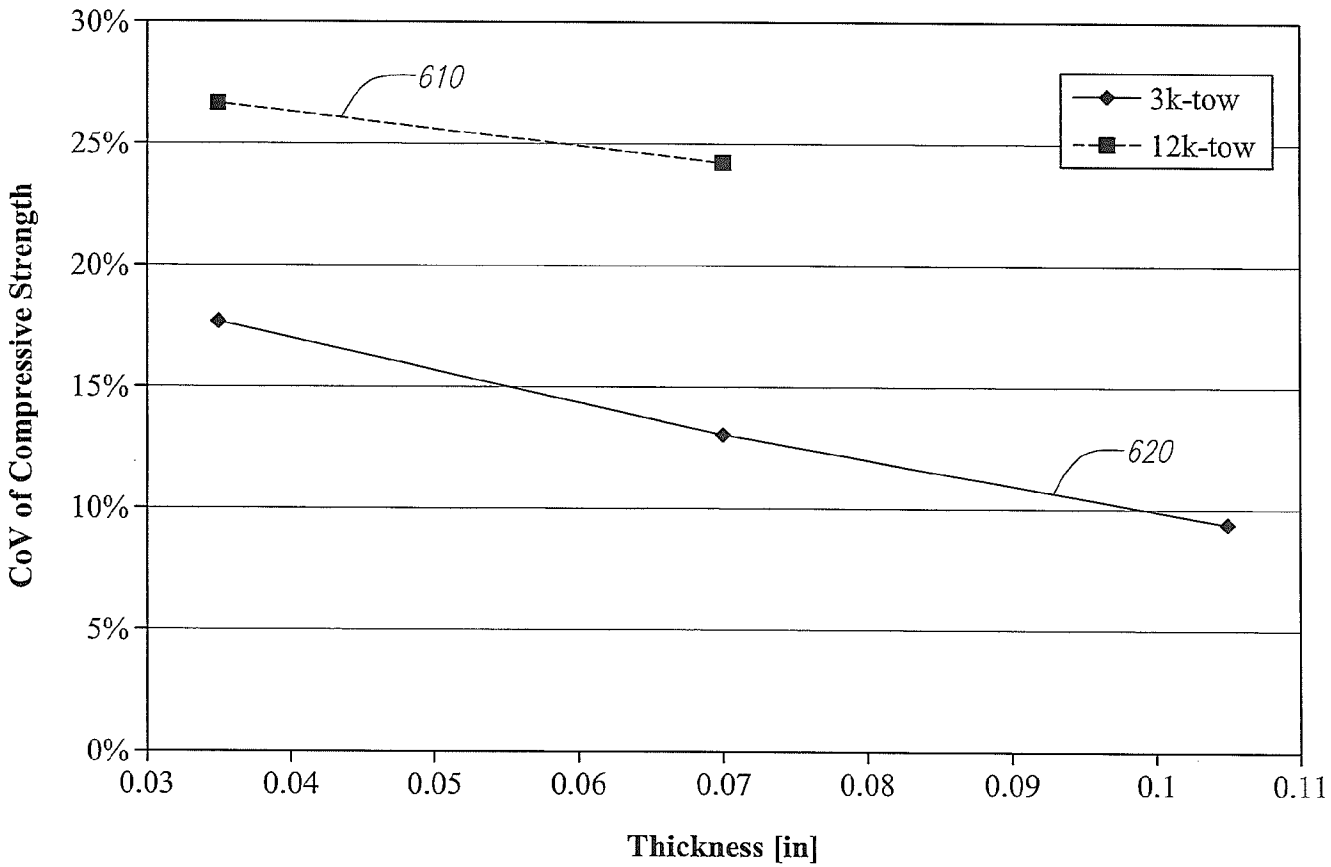
FIG. 6 is a graph of a standard deviation n in strength versus thickness of a standard molding compound and thickness of the molding compound of the present invention.

In addition to allowing for lightweight, strong, and low-density construction of a golf club head, the molding compound of the present invention resolves concerns regarding strength variation. Statistically, the variation in strength of a standard compression molded part increases as specimen thickness decreases. Without sufficient thickness, the random nature of the fiber distribution in ordinary composite materials having 12,000 or more fibers per bundle can lead to a greater chance of there being weak spots in the finished golf club head component, and thus a greater variation in strength, as shown by the dotted line 610 in FIG. 6. In contrast, the smaller carbon fiber bundle diameters (3,000-fiber tow versus 12,000-fiber (or more) tow) used in the molding compound of the present invention allow for a more uniform distribution of fiber orientations for a given part thickness, and thus provide greater strength consistency, as shown by the solid line 620 in FIG. 6.

The use of smaller diameter fiber bundles also assist with molding thin components for a golf club head. The standard compression molding process preferably uses hard metal tooling to apply pressure on both sides of the golf club head component. During the molding process, the molding material of the present invention is forced into the cavity between the two tool surfaces. The hard metal tooling on the IML allows for a precise bond surface geometry on either side of the golf club head component. As a result, the IML surface is a precise as the OML surface. This capability allows for blending of sharp IML corners to alleviate stress concentrations.

Standard molding compounds, however, could not be used to obtain precise IML/OML surfaces, sufficient strength, and uniform fiber distribution in molded composite parts. In contrast, the molding compound of the present invention may be compression molded to achieve strong composite parts having sharp, precise OML and IML surfaces as well as uniform distribution of fiber orientation, thus providing a composite piece that is both strong and precisely formed. A two-piece compression molded body allows a manufacturer to create both a body-over face joint and a body-under face joint and avoid having undercuts.

The molding compound of the present invention also allows for a reduction in scrap when compared to laminated parts, thereby providing savings. Exact placement of the raw material in a molding tool is not required—instead, the raw material is prepared in a form that allows for just one piece of material per golf club head component, which has the effect of eliminating the labor intensive lay-up process as well as scrap waste. As such, the molding compound of the present invention allows for more efficient and environmentally sound manufacturing.

Molding Process

Figure 7:
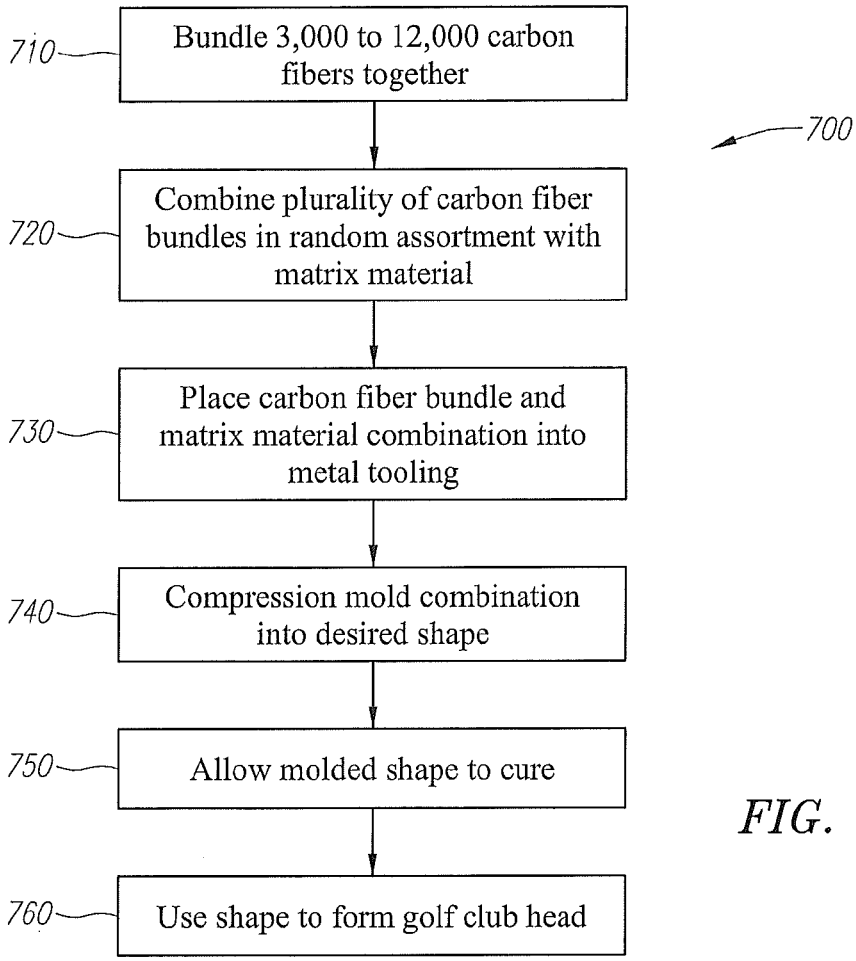
FIG. 7 is a flow chart showing a process for molding a composite compound.

FIG. 7 is a flow chart showing a process 700 for forming a piece of a golf club body using the molding compound of the present invention. In step one 710 of the process 700, approximately 3,000 to 12,000 carbon fibers, and preferably 3,000 carbon fibers, are bundled together to create a unidirectional bundle of carbon fibers having a small diameter. In step two 720, a plurality of said bundles of carbon fibers are randomly assorted and combined with a matrix material to form the molding compound of the present invention. In step three 730, a piece of the molding compound having a desired size and/or shape is placed into a metal tooling. In step four 740, the molding compound is compression molded using the metal tooling to take a desired shape, preferably a crown or sole of a golf club aft body. In step five 750, the molded shape is permitted to cure. In step six 760 of the process 700, the molded shape is used to form a golf club head, and preferably is affixed to other pieces of the golf club head using an adhesive.

EXAMPLE 1

Figure 8:
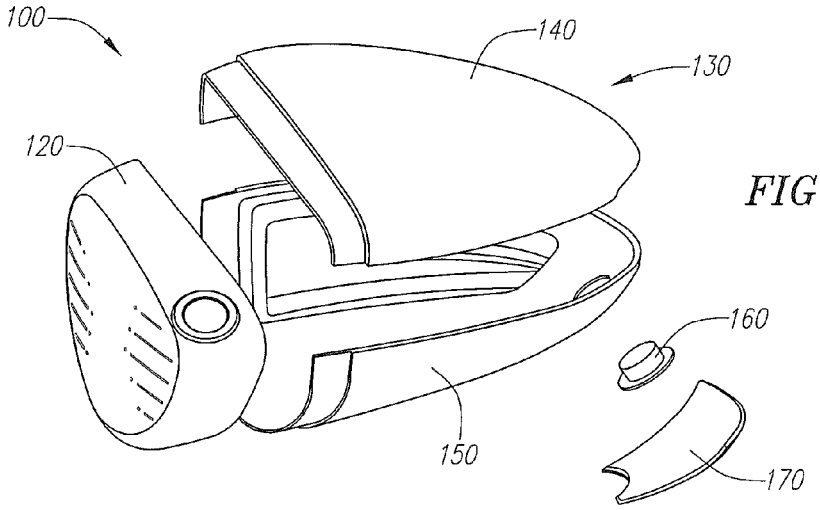
FIG. 8 is an exploded, perspective view of an embodiment of the present invention.

A preferred embodiment of a golf club head 10 formed using the molding compound and molding process of the present invention is shown in FIG. 8. The golf club head 100 is a driver-type head comprising a face cup 120 and an aft body 130 comprising a crown piece 140 and a sole piece 150. The golf club 100 of the present invention may optionally comprise additional pieces, including, but not limited to, a swing weight 160, a rear cover 170, and a ribbon or skirt (not shown) interposed between the crown 140 and sole 150 pieces.

Figure 9:
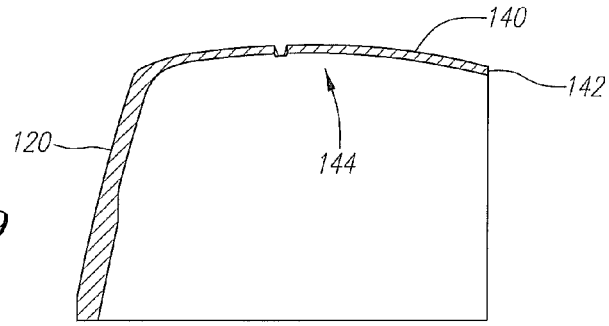
FIG. 9 is an isolated view of a face component aft body joint of the embodiment shown in FIG. 8.

The crown piece 140 and sole piece 150 of the aft body 130 are separately compression molded using the molding compound and process of the present invention. Forming the aft body 130 in two or more pieces makes it easier for a manufacturer to mold the aft body 130, because it is easier to mold half of an aft body 130 than to mold the whole aft body 130 at once. It also removes the need for undercuts. The compression molding process of the present invention allows for a precise OML radius 142 and IML radius 144 for both the crown 140 and the sole 150, shown for the crown 140 in FIG. 9.

Figure 10:
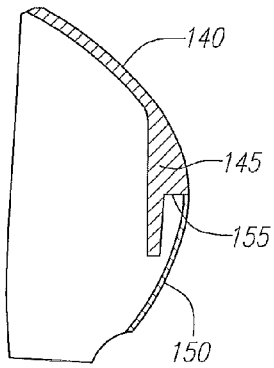
FIG. 10 is an isolated view of a crown-sole joint of an aft-body of the embodiment shown in FIG. 8.
Figure 11:
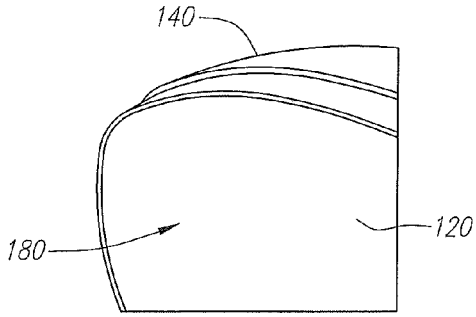
FIG. 11 is an isolated view of an alignment feature of a crown section of the embodiment shown in FIG. 8.

The compression molded crown 140 and sole 150 have wall thicknesses in the 0.020 to 0.125 inch range, and preferably between 0.030 and 0.055 inches, which is a standard thickness range for golf club aft bodies, except for areas which may be thicker to accommodate joint geometry. FIG. 10 shows the joint areas 145, 155 of the crown 140 and sole 150, which are thicker than other portions of the crown and sole and are aligned to join the two aft body pieces 140, 150 together. The joints 145, 155 may have features that are specifically formed to prevent misalignment during bonding and assembly. As shown in FIG. 11, the club head has alignment features 180 for proper assembly.

The compression molded parts 140, 150 are joined together to form a complete composite aft body 130, and the aft body 130 is bonded to the face cup 120, which is preferably made of a metal material, and most preferably made of a titanium alloy. The types of adhesives used to join the golf club head components together include, but are not limited to epoxies, acrylics, and films. The compression molded parts 140, 150 may be a combination of continuous reinforcement and molding compounds.

The aft body of the embodiment shown in FIG. 8 is preferably constructed from a "long fiber" material consisting of the following combination of constituent materials: 20-70% carbon (graphite) fiber by volume; 30-80% thermoplastic or thermoset polymer resin by volume; and up to 20% of other filler materials, including other fibers (Kevlar, fiberglass, nanofibers, nanotubes, or the like). The constituent materials having the following properties: thermoplastic or thermoset polymer resin having a specific gravity between 1.0 and 1.7; carbon (graphite) fiber specific gravity between 1.6 and 2.1; and carbon (graphite) fiber having a tensile modulus of between 25 and 50 Msi.

The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention may take shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

The mass of the club head of the present invention ranges from 165 grams to 250 grams, preferably ranges from 175 grams to 230 grams, and most preferably from 190 grams to 205 grams. The crown component has a mass preferably ranging from 4 grams to 30 grams, more preferably from 15 grams to 25 grams, and most preferably 20 grams.

The golf club head of the present invention preferably has a volume that ranges from 290 cubic centimeters to 600 cubic centimeters, and more preferably ranges from 330 cubic centimeters to 510 cubic centimeters, even more preferably 350 cubic centimeters to 495 cubic centimeters, and most preferably 415 cubic centimeters or 470 cubic centimeters.

The center of gravity and the moment of inertia of a golf club head of the present invention are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

The moment of inertia, Izz, about the Z axis for the golf club heads of the present invention preferably ranges from 2800 g-cm$^2$ to 6000 g-cm$^2$, preferably from 3000 g-cm$^2$ to 600 g-cm$^2$, and most preferably from 5000 g-cm$^2$ to 6000 g-cm$^2$. The moment of inertia, Iyy, about the Y axis for the golf club head preferably ranges from 1500 g-cm$^2$ to 5000 g-cm$^2$, preferably from 2000 g-cm$^2$ to 5000 g-cm$^2$, and most preferably from 3000 g-cm$^2$ to 4500 g-cm$^2$. The moment of inertia, Ixx, about the X axis for the golf club head 40 preferably ranges from 1500 g-cm$^2$ to 4000 g-cm$^2$, preferably from 2000 g-cm$^2$ to 3500 g-cm$^2$, and most preferably from 2500 g-cm$^2$ to 3000 g-cm$^2$.

The golf club heads of the present invention preferably have coefficient of restitutions ("COR") ranging from 0.81 to 0.875, and more preferably from 0.82 to 0.84. The golf club heads preferably have characteristic times ("CT") as measured under USGA conditions of 256 microseconds.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. The section titles included herein also are not intended to be limiting. Therefore, the embodiments of the invention in which an exclusive property or privilege is claimed are defined in the following appended claims.

We claim:

1. A driver type golf club head comprising:

a metal face cup; and a composite aft body comprising a crown and a sole, wherein the composite crown and sole are compression molded, wherein the composite in the crown and sole comprises fibers having random orientation, wherein the composite used to form the crown and sole comprises carbon fibers, wherein the carbon fibers compose 10-70% of the volume of the composite in the crown and sole, and wherein an outer molding line and an inner molding line of the crown and the sole are precision-molded.

2. The driver-type golf club head of claim 1, wherein the aft body has a wall thickness of between 0.020 and 0.125 inches.

3. The driver-type golf club head of claim 2, wherein the aft body has a wall thickness of between 0.030 and 0.055 inches.

4. The driver-type golf club head of claim 1, wherein the crown and sole are molded separately.

5. The driver-type golf club head of claim 1, wherein the carbon fibers compose 40-50% of the volume of the composite in the crown and sole.

6. The driver-type golf club head of claim 1, wherein the composite aft body comprises at least twenty million carbon fibers.

7. The driver-type golf club head of claim 1, wherein at least one of the face cup, crown, and sole comprises alignment markings.

8. The driver-type golf club head of claim 7, wherein the crown and sole comprise alignment markings.

9. The driver-type golf club head of claim 1, wherein the metal face cup comprises a material selected from the group consisting of titanium, titanium alloy, aluminum, aluminum alloy, steel, magnesium, and magnesium alloy.

10. The driver-type golf club head of claim 9, wherein the metal face cup is composed of a titanium alloy.

11. The driver-type golf club head of claim 1, wherein the composite used to form the crown and sole further comprises a matrix material.

12. The driver-type golf club head of claim 11, wherein the matrix material is a thermosetting material.

13. The driver-type golf club head of claim 12, wherein the matrix material is a vinyl ester.

14. A method of forming a composite aft body for a driver type golf club head, comprising:

mixing a plurality of bundles of carbon fibers with a matrix material so that the bundles are assorted randomly to form a composite molding compound;

placing the composite molding compound in a female metal tooling mold;

compressing the composite molding compound within the female metal tooling mold with a male metal tooling mold to create a composite piece;

allowing the composite piece to cure; and bonding the composite piece to another piece of the driver type golf club head, wherein each bundle of carbon fibers is unidirectional;

wherein each bundle includes no more than 12,000 carbon fibers; and wherein the carbon fibers compose 10-70% of the volume of the composite in the crown and sole.

15. The method of claim 14, wherein each bundle includes no more than 3,000 carbon fibers.

16. The method of claim 14, wherein the matrix material is a thermosetting material.

17. The method of claim 14, wherein the matrix material is a vinyl ester.

18. The method of claim 14, wherein the carbon fibers are each between ¼ inch and 2 inches long.

* * * * *